US006854261B2

(12) United States Patent
Williamson et al.

(10) Patent No.: US 6,854,261 B2
(45) Date of Patent: Feb. 15, 2005

(54) SELF-MODE-STIRRED MICROWAVE HEATING FOR A PARTICULATE TRAP

(75) Inventors: Tod Williamson, Malibu, CA (US); Kevin W. Kirby, Calabasas Hills, CA (US); Amanda Phelps, Malibu, CA (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/200,671

(22) Filed: Jul. 22, 2002

(65) Prior Publication Data

US 2004/0011024 A1 Jan. 22, 2004

(51) Int. Cl.[7] ..... F01N 3/00

(52) U.S. Cl. ..... 60/275; 60/274; 60/300; 60/303; 95/283; 55/DIG. 5

(58) Field of Search ..... 60/274, 275, 303, 60/311, 300; 95/278, 283; 55/DIG. 5, DIG. 10

(56) References Cited

U.S. PATENT DOCUMENTS 5,074,112 A * 12/1991 Walton et al. ..... 60/275
5,180,559 A * 1/1993 Ma ..... 422/168
5,194,078 A * 3/1993 Yonemura et al. ..... 55/466
5,195,317 A * 3/1993 Nobue et al. ..... 60/275
5,453,116 A * 9/1995 Fischer et al. ..... 95/278
5,822,977 A * 10/1998 Fukuda et al. ..... 60/274
6,080,976 A * 6/2000 Nara ..... 219/687
6,284,202 B1 * 9/2001 Cha et al. ..... 422/186

FOREIGN PATENT DOCUMENTS

JP 407222912 A * 8/1995 ..... 60/311

* cited by examiner

*Primary Examiner*—Binh Q. Tran
(74) *Attorney, Agent, or Firm*—Christopher DeVries

(57) ABSTRACT

A method and apparatus for initiating regeneration in a particulate trap including the steps of locating self-mode-stirring microwave-absorbing material in the particulate trap in areas that particulates build up, generating microwaves, absorbing microwaves with the microwave-absorbing material, and controlling the microwaves to initiate a burn-off of particulates.

15 Claims, 3 Drawing Sheets

SELF-MODE-STIRRED MICROWAVE HEATING FOR A PARTICULATE TRAP

TECHNICAL FIELD

The present invention relates to a diesel particulate trap. More specifically, the present invention relates to a method and apparatus for regenerating a diesel particulate trap using microwave radiation and materials with self-mode-stirring properties.

BACKGROUND OF THE INVENTION

Increased government regulation has reduced the allowable levels of particulates generated by diesel engines. The particulates can generally be characterized as a soot that is captured by particulate filters or traps. Present particulate filters or traps contain a separation medium with tiny pores that capture particles. As trapped material accumulates in the particulate trap, resistance to flow through the particulate trap increases, generating backpressure. The particulate trap must then be regenerated to burn off the particulates/soot in the particulate trap to reduce the backpressure and allow exhaust flow through the particulate trap. Past practices of regenerating a particulate trap utilized an energy source such as a burner or electric heater to generate combustion in the particulates. Particulate combustion in a diesel particulate trap by these past practices has been found to be difficult to control and may result in an excessive temperature rise.

Presently, conventional microwaves and microwave radiation are used in a variety of settings, including conventional microwave ovens. Heating by a microwave oven can be accomplished with a nonresonant cavity which is not designed with the purpose of exciting any particular microwave mode pattern. The field distribution within the nonresonant cavity will naturally exhibit standing waves, such that the microwave power absorption in a material exposed to the microwaves will be nonuniform. Analogous problems with using microwaves to heat a particulate trap in automotive applications also exist. Only portions of a microwave particulate trap may be heated when exposed to microwaves, leading to thermal runaway and less than satisfactory combustion of particulates in the particulate trap. This nonuniform heating can be minimized by the use of multiple microwave frequencies and/or mode-stirring using mechanical systems such as fan blades to cause a standing wave pattern to change in time in the cavity. Mechanical mode-stirring and the use of multiple microwave frequencies are not practical solutions in automotive microwave heating applications.

SUMMARY OF THE INVENTION

The present invention is a method and apparatus for regenerating an automotive diesel particulate trap using microwave energy. The present invention allows for the absorption of microwaves in select locations in a particulate trap such as near an inlet channel or end plug of a particulate trap to initiate regeneration and remove particulate build up. By absorbing microwaves in select locations, a relatively small amount of energy initiates the particle combustion that regenerates the particulate trap. The exotherm from the combustion of a small amount of particulates is leveraged to burn a larger number of particulates.

The present invention further utilizes "self-mode-stirring" (SMS). To understand the concept of SMS, an analysis of microwave propagation will be described in the following examples.

Propagation of the Electric ($E_x$) and Magnetic ($H_y$) components of a microwave can be described by the following equations:

$$E_x=E_0e^{i\omega t}e^{-\gamma z} \tag{1a}$$

$$H_y=H_0e^{i\omega t}e^{-\gamma z} \tag{1b}$$

where $E_0$ is equal to the amplitude of the electric field, $H_0$ is equal to the amplitude of the magnetic field, $\omega$ represents the angular frequency, t is the time, $\gamma$ describes the attenuation of the electromagnetic wave as is propagates through a sample, and z is the position of wave along the propagation direction. The attenuation generated by the parameter $\gamma$ is related to the complex material values for permittivity ($\epsilon^*$) and permeability ($\mu^*$) by the following equation:

$$\gamma=i\omega(\epsilon^*\mu)^{1/2} \tag{2}$$

The complex permittivity and permeability represent the dielectric and magnetic coupling of the material to incident microwave energy. The amount of microwave absorption and the pattern of cavity resonances are dependent on the permittivity and permeability. The complex permittivity and permeability have a real and imaginary part as shown in the following equations:

$$\epsilon=\epsilon'+i\epsilon'' \tag{3(a)}$$

$$\mu=\mu'+i\mu'' \tag{3(b)}$$

The imaginary parts of the permittivity ($\epsilon''$) and permeability ($\mu''$) are responsible for the absorption of microwaves that lead to the heating of a material. These imaginary parts should be as large as possible in comparison to their real parts to generate effective absorption and heating. The figure of importance for a material, with respect to microwave heating, is a simple ratio of the imaginary part to the real part of the permittivity and permeability, known as the loss tangent. By selecting materials that have relatively large loss tangents, microwave absorption will be increased (as compared to materials with small loss tangents such as cordierite, the material from which a trap is made) in a particulate trap coated with these large-loss tangent materials. The electric and magnetic loss tangents, tan $\delta_e$ and tan $\delta_m$, are described by the following equations:

$$\tan\delta_e=\epsilon'/\epsilon'' \tag{4(a)}$$

$$\tan\delta_m=\mu'/\mu'' \tag{4(b)}$$

The present invention includes a particulate trap placed in the exhaust flow of a diesel engine. The particulate trap includes SMS microwave-absorbing materials configured to absorb microwaves in selected locations in the particulate trap. A microwave source may be operatively coupled to a wave guide, and a focus ring may be used to direct the microwaves to the microwave-absorbing materials. The microwave-absorbing material generates heat in response to incident microwaves to ignite and burn off particulates. Materials substantially transparent to microwaves are preferably used for the basic construction of the particulate trap and other areas in the particulate trap where it would be inefficient to absorb microwave energy.

In the present invention, the delivery of microwaves to the particulate trap is configured such that the microwaves are incident upon the microwave-absorbing material. By strategically locating the microwave-absorbing materials, microwaves may be used efficiently at the locations they are most needed to initiate the burn-off of particulates.

The use of microwaves in the present invention further allows the frequency of particulate trap regeneration to be precisely controlled. The present invention may schedule regenerations based on empirically-generated particulate trap operation data and/or utilize a pressure sensor to determine when the particulate trap requires a regeneration.

Materials such as mineral cordierite are used to make the basic structure of a diesel particulate trap. Cordierite does not have large enough loss tangents to efficiently utilize microwave radiation in the regeneration of particulate traps. Cordierite has a relatively small loss tangent at the common magnetron microwave frequency of 2.45 GHz and changes little with temperature. Consequently, cordierite particulate traps tend to be virtually transparent to incident microwaves. The present invention includes materials with relatively high-loss tangents coated to the interior surfaces of a particulate trap. The coating materials will have a loss tangent that varies with temperature to remove undesirable static hot and cold regions in the particulate trap. As the material loss tangent varies with temperature, so will the mode pattern in the microwave cavities of the particulate trap, producing self-mode stirring (SMS).

The present invention includes materials with SMS properties that also avoid thermal runaway conditions. This is accomplished by materials exhibiting an initial increase in loss tangent to a critical temperature (Curie temperature), followed by a sharp decrease in loss tangent above the Curie temperature. Materials exhibiting these properties include ferroelectric and/or ferro-or ferrimagnetic oxides. These materials encompass compositions that have an initially high loss tangent that increases up to the Curie temperature. Beyond the Curie temperature, the loss tangent decreases sharply due to the inability of the microwaves to induce either electric or magnetic polarizations in the material. The preferred material will exhibit a relatively high electrical resistivity at the Curie temperature.

DESCRIPTION OF THE PREFERRED EMBODIMENT

Figure 1:
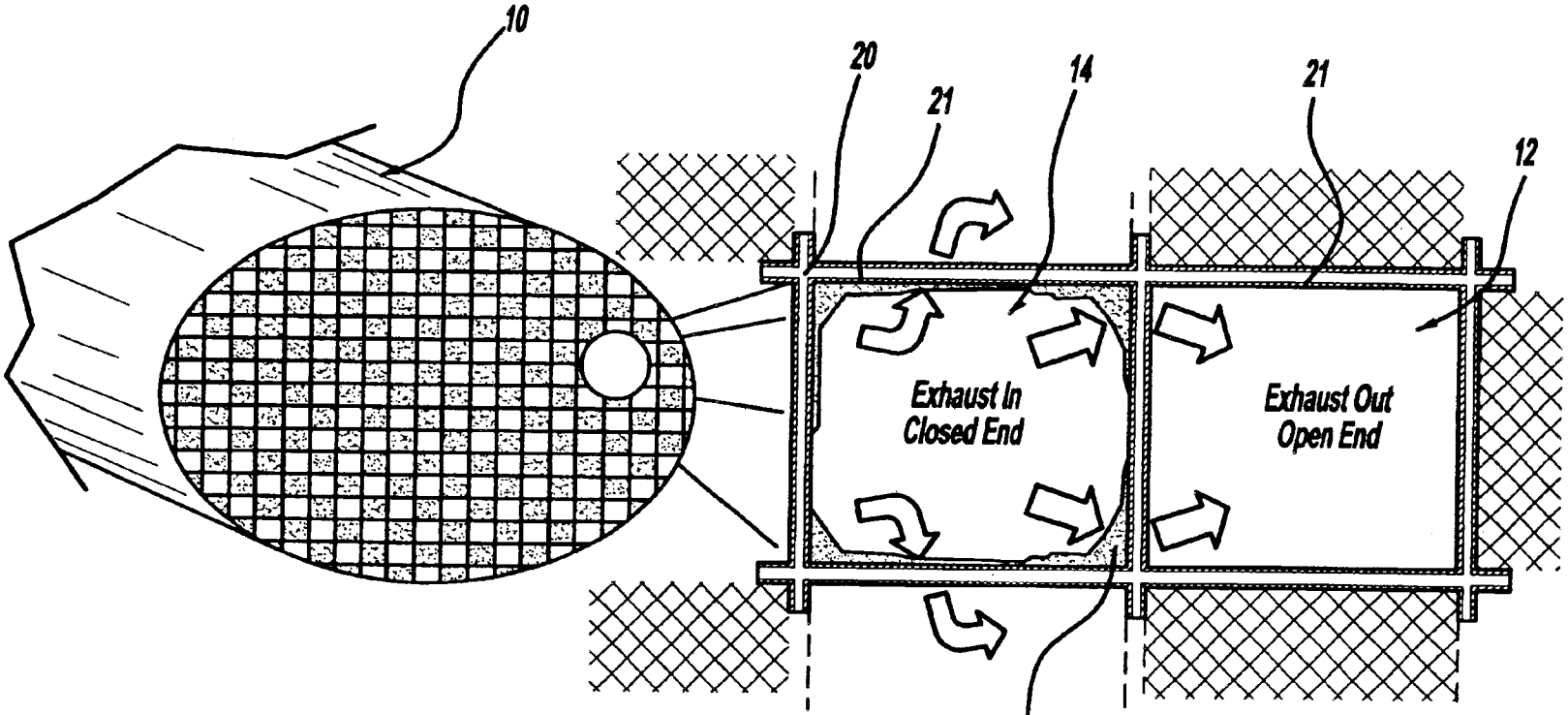
FIG. 1 is a diagrammatic drawing of a wall flow monolith particulate trap.
Figure 3A:
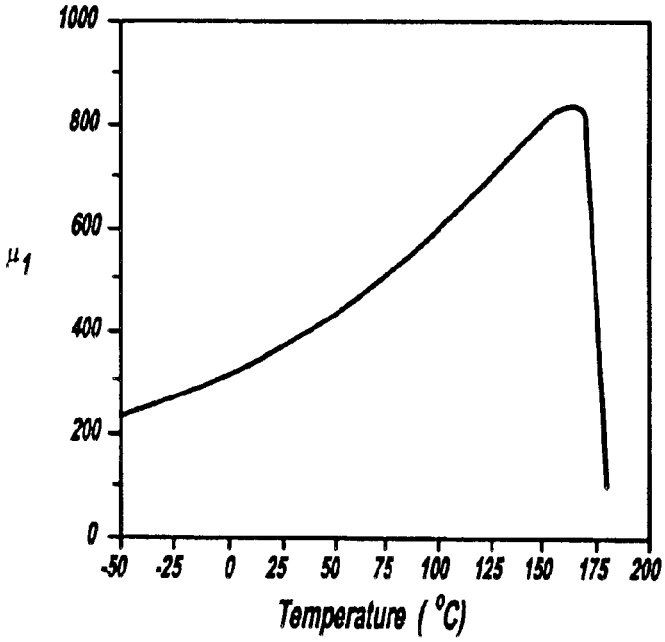
FIGS. 3*a* and 3*b* are plots illustrating initial permeability versus temperature.
Figure 3B:
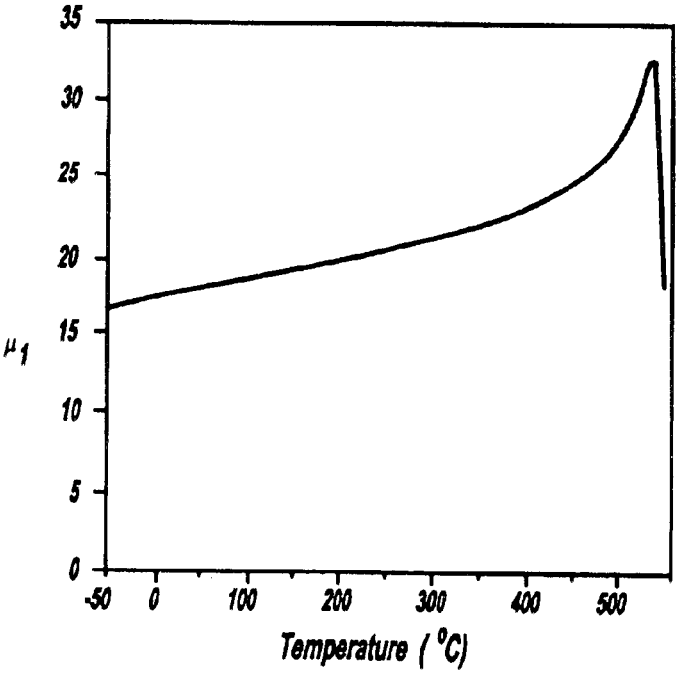

FIG. 1 is a diagrammatic drawing of a typical wall flow monolith particulate trap 10 "particulate trap" used in diesel applications. The particulate trap 10 includes alternating closed cells/channels 14 and open cells/channels 12. Exhaust gases such as those generated by a diesel engine enter the closed end channels 14, depositing particulate matter 16 and exit through the open channels 12. The walls 20 of the particulate trap are preferably composed of a porous ceramic honeycomb wall of cordierite material, but any ceramic honeycomb material is considered within the scope of the present invention. The walls 20 of the particulate traps in the preferred embodiment are coated with materials 21 having SMS properties and decreasing loss tangent beyond the Curie temperature. In alternate embodiments of the present invention, SMS materials may be configured as walls or end plugs in the particulate trap 10. The SMS materials include, but are not limited to, magnetic ferrites having the general formula $M^{2+}O.Fe_2^{3+}O_3$, where $M^{2+}$ is a divalent cation such as $Fe^{2+}$, $Ni^{2+}$, $Zn^{2+}$, $Cu^{2+}$, $Mg^{2+}$, or a combination; other magnetic oxides including rare earth garnets, orthoferrites, hexagonal ferrites, and ilmenites; and other magnetic materials exhibiting a relatively large decrease in magnetic permeability ($\mu$) and loss tangent ($\tan \delta_m$) as they pass through their Curie temperature. An example of materials having SMS properties is illustrated in FIGS. 3*a* and 3*b* where the initial permeabilities of two different Ni—Zn ferrites are plotted as a function of temperature.

As illustrated in FIG. 3, the Curie temperature can vary widely depending on the chosen composition of the material used for coating the particulate trap 10 and exposed to microwaves. The Curie temperatures for ferrite powders typically range from 120–600° Celsius. Similarly, common ferroelectric materials, with analogous permittivity and dielectric loss tangent properties, have Curie temperatures in the range of 130–1200° Celsius. Ferroelectric materials include oxides with the formula $ABO_3$, where A may be $Ba^{2+}$, $Pb^{2+}$, $La^{3+}$, $K^+$, or $Li^+$, and B may be $Ti^{4+}$, $Zr^{4+}$, $Nb^{5+}$, $Ta^{5+}$, or a combination.

By choosing a particulate trap material or material coating with the appropriate Curie temperature and resistivity and through selective coating of the sample (graded thickness, hybrid coating), uniform heating of a sample with low power microwaves ($\leqq$1 kW) to any target temperature can be achieved in a particulate trap 10.

Figure 2:
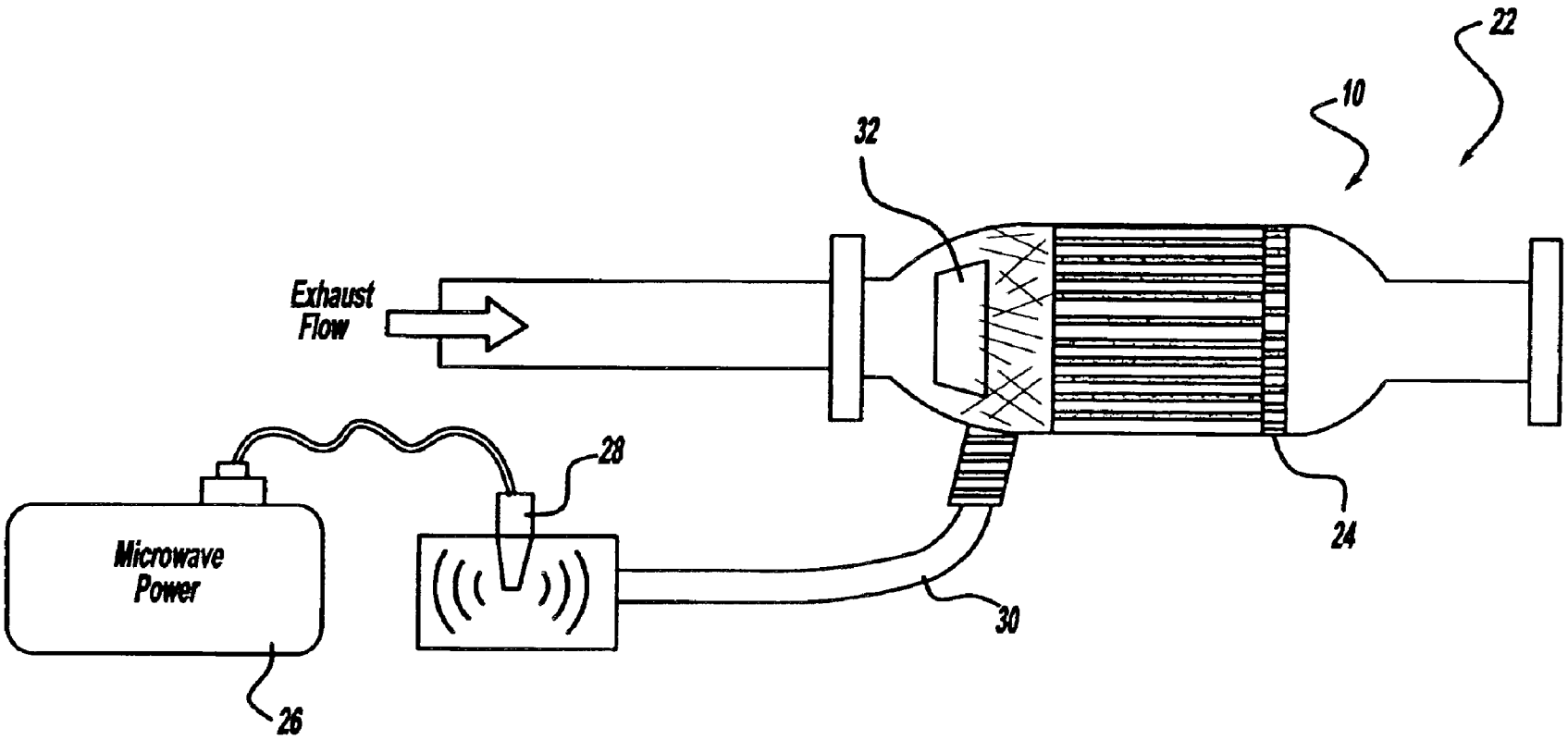
FIG. 2 is a diagrammatic drawing of the microwave regeneration system of the present invention.

FIG. 2 is a diagrammatic drawing of a preferred embodiment of the microwave system 22 of the present invention. The system 22 includes the particulate trap 10 having end plugs 24 placed in the exhaust flow of a diesel engine. The particulate trap 10 includes a SMS microwave-absorbing material 21, such as those previously described, coated and configured to absorb microwaves in selected locations in the particulate trap 10. A microwave power source 26 and microwave antenna 28 are operatively coupled to a wave guide 30 and an optional focus ring 32 to direct the microwaves to the microwave-absorbing material 21. In alternate embodiments of the present invention, the microwave antenna 28 is directly coupled to the housing of the particulate trap 10. The microwave-absorbing material 21 generates heat in response to incident microwaves to initiate the burn-off of particulates in the particulate trap 10. The temperature of the particulate trap 10 may be regulated by the properties and location of the microwave-absorbing materials 21 and by controlling the application of the microwave energy.

It is to be understood that the invention is not limited to the exact construction illustrated and described above, but that various changes and modifications may be made without departing from the spirit and scope of the invention as defined in the following claims.

What is claimed is:

1. A particulate filter for an internal combustion engine comprising:

a substantially microwave transparent material forming the structure of the particulate filter, the particulate filter including alternating closed and open channels in a honeycomb configuration; and microwave-absorbing materials coupled to the microwave transparent materials, said microwave absorbing materials having a Curie temperature threshold to absorb said microwaves and generate heat to burn particulates.

2. The particulate filter of claim 1 wherein said microwave-absorbing material is a ferrite.

3. The particulate filter of claim 1 wherein said microwave-absorbing material is a ferroelectric oxide.

4. The particulate filter of claim 1 wherein said microwave-absorbing material is coated onto the interior structure of the particulate filter.

5. The particulate filter of claim 1 wherein said microwave-absorbing material is any magnetic material.

6. The particulate filter of claim 1 wherein said particulate trap is comprised of cordierite.

7. The particulate filter of claim 1 wherein said particulate trap is comprised of a ceramic material substantially transparent to microwaves.

8. A method of regenerating a particulate trap comprising:

generating microwave radiation;

providing self-mode-stirring microwave-absorbing material in the particulate traps; and absorbing microwaves with the self-mode-stirring microwave material to generate heat to burn particulates in the particulate trap;

determining exhaust gas flow using a pressure sensor; and regenerating the particulate trap based upon a pressure reading from said pressure sensor.

9. The method of claim 8 further comprising the step of coating microwave-absorbent material along walls of the particulate trap.

10. The method of claim 8 further comprising the step of coating microwave-absorbent material on the end plugs of the particulate trap.

11. The method of claim 8 further comprising the step of controlling the temperature of the particulate trap by controlling the microwave radiation and empirically determining the application of the microwave energy to regenerate the particulate trap.

12. A system for removing particulates in a particulate trap comprising:

a microwave power source;

a microwave antenna coupled to said power source for generating microwaves;

a microwave wave guide operatively coupled to sold microwave antenna to guide said microwaves;

a pressure sensor detecting exhaust gas pressure in said particulate trap; and microwave-absorbent material having a Curie temperature located in said particulate trap, wherein said microwaves are incident upon said microwave-absorbent material to generate hear to burn off particulates located in said particulate trap based upon said pressure sensor output.

13. The system of claim 12 further comprising a diesel engine coupled to said particulate trap, wherein diesel exhaust propagates through said particulate trap.

14. A method of initiating regeneration in a particulate trap comprising the steps of:

locating self-mode-stirring microwave-absorbing material in the particulate trap in areas that particulates build up;

generating microwaves;

absorbing microwaves with the microwave-absorbing material; and controlling the microwaves to initiate a burn-off of particulates in response to a pressure in the particulate trap.

15. A particulate filter for an internal combustion engine comprising:

a housing forming channels in the particulate filter, said channels alternately closed and open and arranged in honeycomb fashion; and self-mode-stirring microwave-absorbing materials coupled to walls of the channels to absorb said microwaves and generate heat to burn particulates.

* * * * *